US005531619A

United States Patent [19]

Nakase et al.

[11] Patent Number: 5,531,619

[45] Date of Patent: Jul. 2, 1996

[54] CONTROL DEVICE FOR MARINE PROPULSION UNIT ENGINE

[75] Inventors: Ryoichi Nakase; Shigeyuki Ozawa, both of Hamamatsu, Japan

[73] Assignee: Sanshin Kogyo Kabushiski Kaisha, Hamamatsu, Japan

[21] Appl. No.: 143,342

[22] Filed: Oct. 25, 1993

[30] Foreign Application Priority Data

Oct. 24, 1992 [JP] Japan ..... 4-309245

[51] Int. Cl.[6] ..... B63H 21/38

[52] U.S. Cl. ..... 440/1; 440/2; 440/88

[58] Field of Search ..... 440/1, 2, 88; 123/41.15

[56] References Cited

U.S. PATENT DOCUMENTS 4,019,489 4/1977 Cartmill ..... 440/1 X 4,147,151 4/1979 Wright ..... 123/41.15 X 4,857,023 8/1989 Takashima ..... 440/88

*Primary Examiner*—Sherman Basinger

*Attorney, Agent, or Firm*—Knobbe, Martens, Olson & Bear

[57] ABSTRACT

An arrangement and structure for running a marine engine for a brief period of time after the engine cooling jacket has been depleted of water so as to insure complete purging of water and water vapor from within the engine. In the illustrated embodiment, this operation is initiated by actuation of the starter switch and a timer is started to run only in the event the coolant is not in the engine for shutting of the engine after the lapse time has run.

10 Claims, 5 Drawing Sheets

CONTROL DEVICE FOR MARINE PROPULSION UNIT ENGINE

BACKGROUND OF THE INVENTION

This invention relates to a control device for a marine propulsion unit engine and more particularly to an improved system for purging cooling water from the engine when the marine vehicle is taken out of service.

It is well known that one of the operational difficulties with marine propulsion engines is that the engine may ingest a large amount of water, regardless of how well it is protected, during operation of the watercraft. That is, either an outboard or an inboard engine may receive through its induction system fairly large amounts of water. This water, if it is permitted to be retained in the engine for any period of time can be a problem, particularly where the watercraft is operating in a marine environment and the water may contain large amounts of salt.

While the engine is running, any water which may be ingested through the induction system will be vaporized by the heat of the engine and deposits present no significant problem. However, if the engine is shut off, particularly after a large amount of water may be ingested due to capsizing or the like, this water if permitted to remain in the engine can present problems of corrosion. It has, therefor, been the common practice for operators manuals to suggest running the engine for a brief period of time after the watercraft or engine is taken out of service. That is, once the water vehicle, in the case of an inboard engine craft, or the outboard motor either when attached to a watercraft or when detached from it and not in use to run the engine for a brief period of time with no coolant in the engine. Such brief running will generate sufficient heat so as to vaporize any water which may be in the engine and dispose of it. In addition, this will leave fuel and lubricant in the engine so as to avoid against corrosion.

There is, however, a problem with such running of the engine when the cooling system has been depleted of its coolant. If the engine is run too long, over heating can clearly result and damage may be encountered. On the other hand, if the engine is not run a sufficient length of time, then water vapor can still be retain in the engine and the aforenoted problems result.

It is, therefor, a principle object of this invention to provide an improved control for a marine engine so as to permit the interior of the engine to be purged from water vapor without damaging the engine.

It is a further object of this invention to provide an improved control for running an engine for a marine watercraft for a brief period of time when the engine cooling jacket has been depleted of its coolant.

In addition to the problems of having water vapor enter into the interior of the engine, it is also desirable to purge the engine cooling jacket of any liquid once the engine is being taken out of service. This is done in a manner similar to the manner for purging the interior running components from water vapor.

SUMMARY OF THE INVENTION

This invention is adapted to be embodied in a device and method for assisting in the purging of water from a water cooled marine engine having a cooling jacket through which coolant is circulated from a body of water when the engine is propelling an associated watercraft through the body of water. Means are provided for automatically running the engine for a period of time after the flow of coolant to the cooling jacket has discontinued.

DETAILED DESCRIPTION OF THE PREFERRED EMBODIMENT OF THE INVENTION

Figure 1:
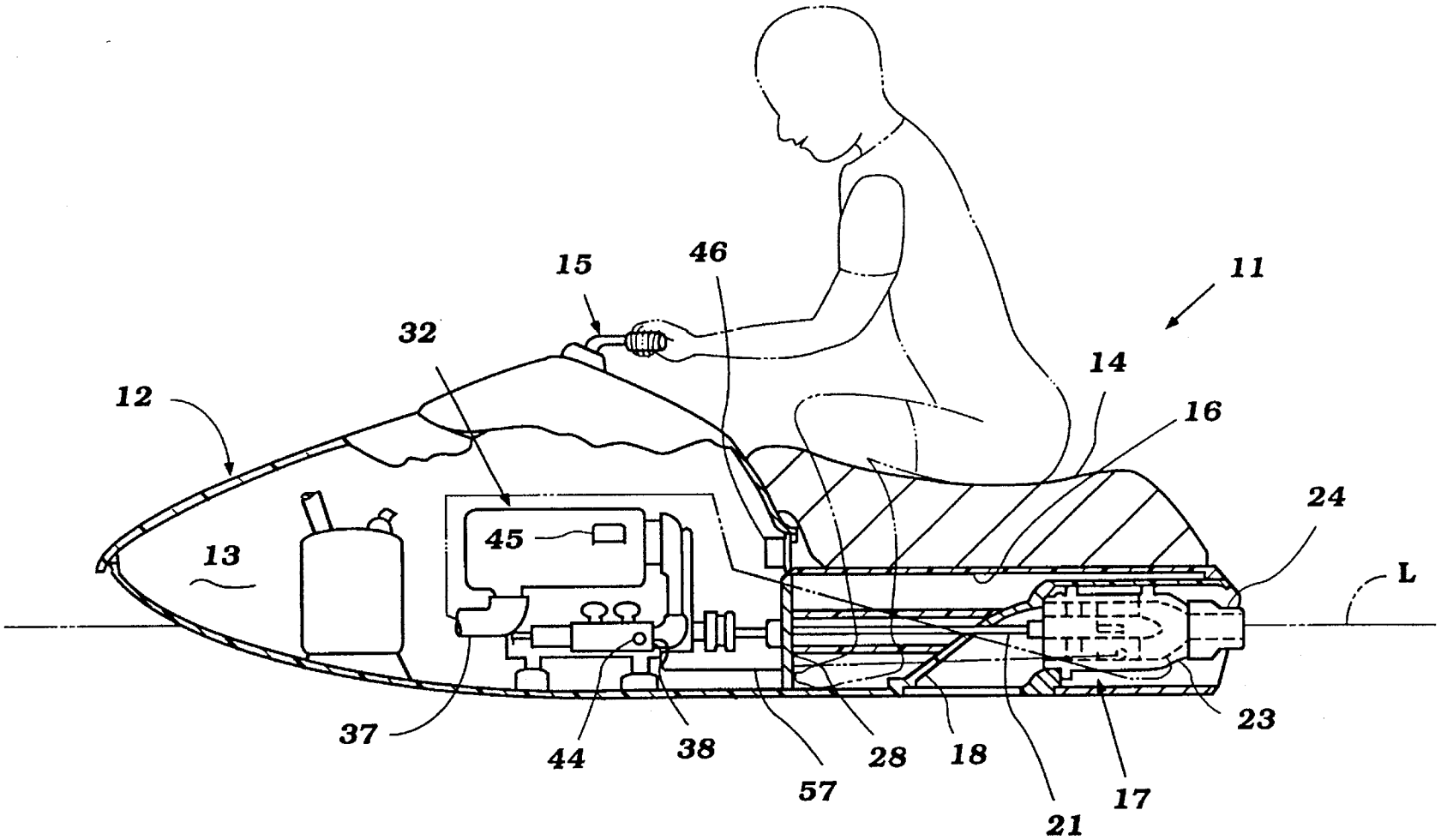
FIG. 1 is side elevational view of a watercraft having an engine and purging system control constructed in accordance with an embodiment of the invention, with a portion broken away to more clearly show the construction.
Figure 2:
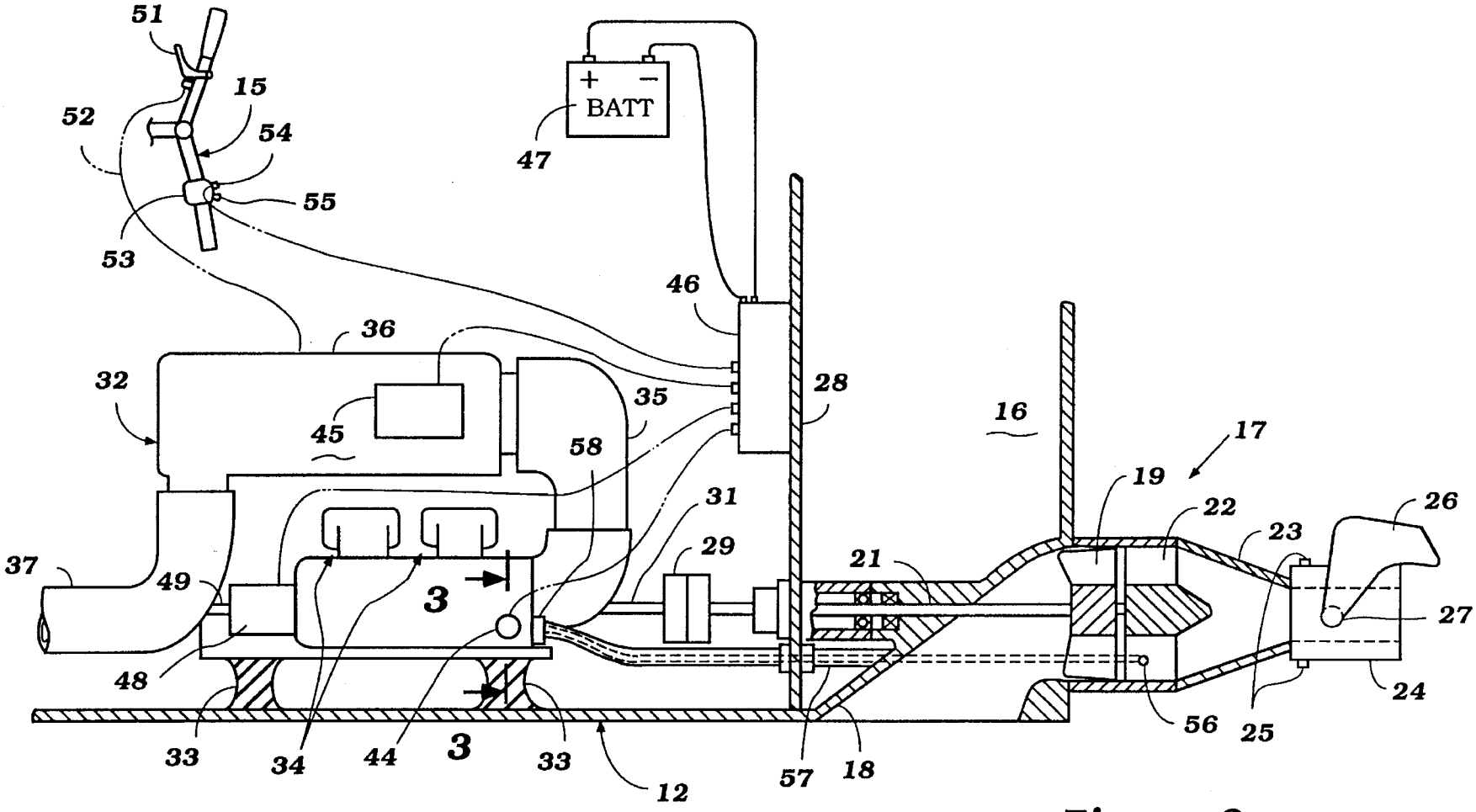
FIG. 2 is an enlarged cross-sectional view of a portion of the watercraft shown in FIG. 1 and shows in more detail certain of the components and their relationship.
Figure 3:
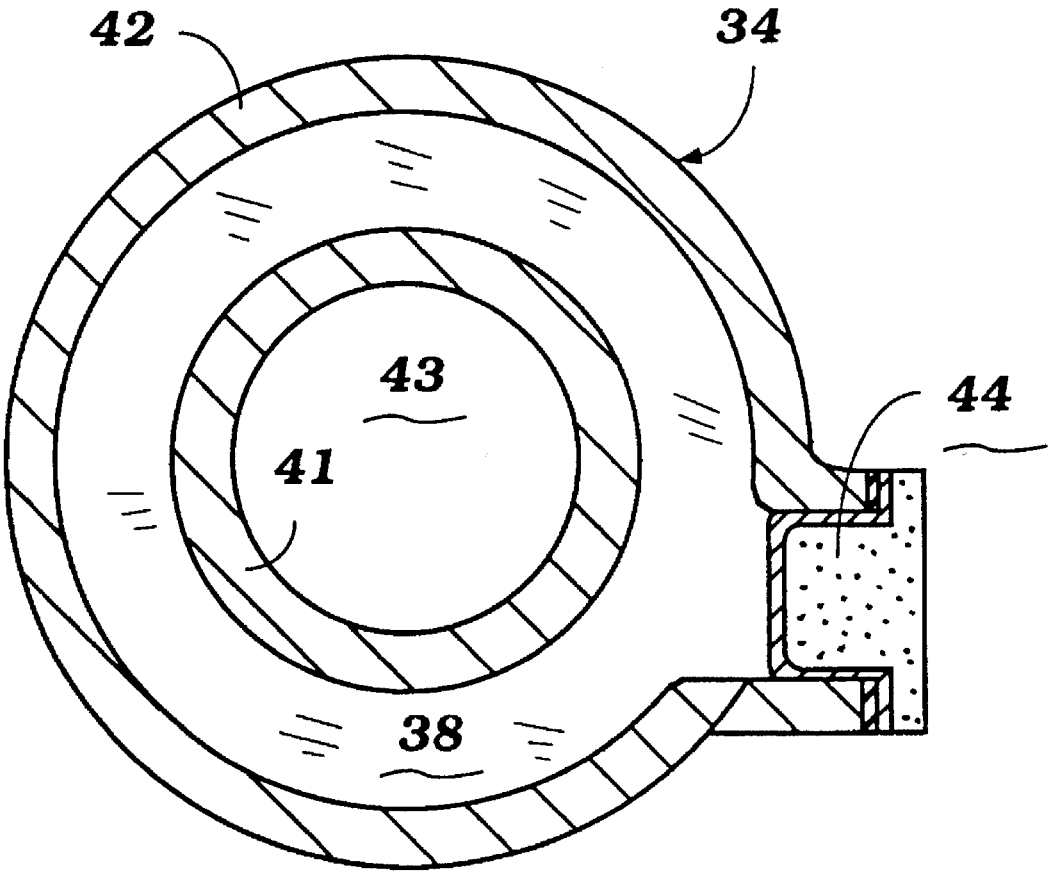
FIG. 3 is an enlarged cross-sectional view taken along the line 3—3 of FIG. 2.

Referring now in detail to the drawings and initially to FIGS. 1–3, a small watercraft constructed and operated in accordance with an embodiment of the invention is identified generally by the reference numeral 11. The watercraft 11 is depicted as being of the small jet propelled type commonly called a "personal watercraft". The invention is described in conjunction with such a watercraft as it has particular utility in such an application. However, it is to be also understood that the invention may be utilized on a wide variety of types of watercraft including those having inboard engines or those powered by outboard engines. The way in which the invention can be utilized in conjunction with a variety of different types of watercraft will be apparent to those skilled in the art from the following the description.

The watercraft 11 is comprised of a hull, indicated generally by the reference numeral 12 and which may be formed from any suitable material such as a molded fiberglass reinforced plastic or the like. The forward portion of the hull 12 defines an engine compartment, indicated generally by the reference numeral 13. To the rear of the engine compartment 13 there is provided a passengers area that includes a seat 14 which, in accordance with the type of watercraft illustrated, is adapted to accommodate one or more riders seated in straddle tandem fashion. A handlebar assembly 15 is provided forwardly of the seat 14 for certain controls for the watercraft 11 as will be described.

The area of the hull 12 beneath the seat 14 is defined with a tunnel 16 in which a jet propulsion unit, indicated generally by the reference numeral 17 is provided. Although the invention is described in conjunction with a jet propelled watercraft, it will be apparent to those skilled in the art that the invention may be utilized with types of watercraft having different propulsion systems or, as has been previously noted, with watercraft powered by outboard motors and having any known type of outboard propulsion unit.

The jet propulsion unit 17 is comprised of an outer housing that defines a downwardly facing water inlet opening 18 which is generally flush with the hull 12 and through which water is drawn by means of an impeller 19 that is coupled to an impeller shaft 21. This water is then discharged rearwardly past straightening vanes 22 to a discharge nozzle portion 23. A steering nozzle 24 is supported for steering movement about a vertically extending axis by means of a pair of pivot pins 25 for steering of the watercraft by means of the handlebar assembly 15. A suitable bowden wire connection (not shown) inner-connects the handlebar assembly 15 with the steering nozzle 24 as is well know in this art.

A reverse thrust bucket 26 is also pivoted on the steering nozzle 24 by pivot pins 27 and can be operated by any suitable remote control.

The impeller shaft 21 extends forwardly through a bulkhead 28 formed by the hull 12 at the forward portion of the tunnel 16. This impeller shaft 21 is thus coupled by means of a flexible coupling 29 to an output shaft 31 of an internal combustion engine, indicated generally by the reference numeral 32 and which is mounted in the engine compartment 13 on a pair of engine mounts 33.

The engine 32 may be of any known type but, in accordance with the invention, is water cooled in a manner which will be described. In the illustrated embodiment, the engine 32 is depicted of being of the inline two cylinder type operating on a two stroke crankcase compression principle. Of course, the engine 32 can be of any other known type having any number of cylinders and operating on either the two or four stroke principles.

The internal construction of the engine 32, except for the cooling system, as will be described, forms no part of the invention and, for that reason, will not be described in further detail. However, the engine 32 has an exhaust system that is comprised of an exhaust manifold 34 which receives the exhaust gases from exhausts ports of the engine and delivers them through an exhaust elbow 35 to a combined expansion chamber and silencing device 36. The exhaust gases are then discharged to the atmosphere through a flexible exhaust pipe 37 which terminates in the tunnel 16. Except for the fact that the exhaust system is water cooled in a manner to be described and that the cooling water for the engine is discharged back through the body of water in which the watercraft is operating through the exhaust pipe 37, the details of its construction also are not necessary to understand the invention.

The exhaust manifold 34 is provided with a cooling jacket 38 as shown in FIG. 3 which is formed by a double wall construction comprised of an inner pipe 41 and an outer pipe 42. The inner pipe 41 defines a passage 43 to which the exhaust gases are delivered from the exhaust ports and communicates at its rear end with the exhaust elbow 35. A water coolant sensor 44 is provided in the outer wall of the manifold 34 for a reason will be described.

The engine 32 is spark ignited and its ignition system 45 which may be mounted in any location such as on the expansion chamber 32 and which may be of any known type for firing the spark plugs associated with the engine. Again, any conventional ignition system may be employed and since the ignition system per se is conventional, its detailed description is also not necessary to understand the construction and operation of the invention.

The ignition system 45 is powered and controlled by a control box, indicated generally by the reference numeral 46 and which is mounted on the engine compartment side of the bulkhead 28. This control box 46 receives electrical power from a battery 47 which may be charged through a suitable generating system associated with the engine 32.

The engine 32 also includes an electrical starter 48 which has a starter shaft 49 that is coupled to the engine output shaft 31 in a known manner for electrical starting of the engine. This starter is controlled via the control box 46 in a manner which will also be described.

Handlebar assembly 15 supports certain controls in addition to the steering controls and these include a throttle control 51 which is coupled by a bowden wire acuator 52 to the throttle valves of the engine for controlling the engine speed. In addition, a control box 53 is connected to the handlebar 15 in an appropriate manner and carries a starter switch 54 which controls the starter 48 through the control box 46. In addition, the control 53 carries a kill switch 55 which is adapted to disable the ignition system 45 and discontinue the firing of the spark plugs of the engine so as to stop the engine.

The remainder of the construction of the cooling system for the engine 32 will now be described and this includes a water pressure pick off 56 that is provided between the straightening vanes 22 of the jet propulsion unit 17 and which receives a portion of the water pressurized by the impeller 19 and delivers it through a supply conduit 57 to a coolant inlet fitting 58 formed at the rear of the manifold cooling jacket 38. The coolant thus delivered flows through the exhaust manifold cooling jacket 38 and then is delivered to the engine cooling jacket in an appropriate manner. This coolant is then circulated through the engine cooling jacket and is again returned to the exhaust system either through the elbow 35 or expansion chamber 36 for discharge back in to the body of water in which the watercraft is operating.

It has been previously noted, it desirable to run the engine 32 for a brief period of time after the watercraft 11 is taken out of service so as to insure that any water which may have entered the interior of the engine 32 through its induction system is purged and to insure that all water which may remain in the engine cooling jackets and the cooling jacket of the exhaust system including the manifold cooling jacket 38 will be purged by heating it sufficiently so as to vaporize it. However, it is desirable that the engine not be run for too long a period of time so as to avoid over heating once the engine cooling jacket is depleted of water.

Figure 4:
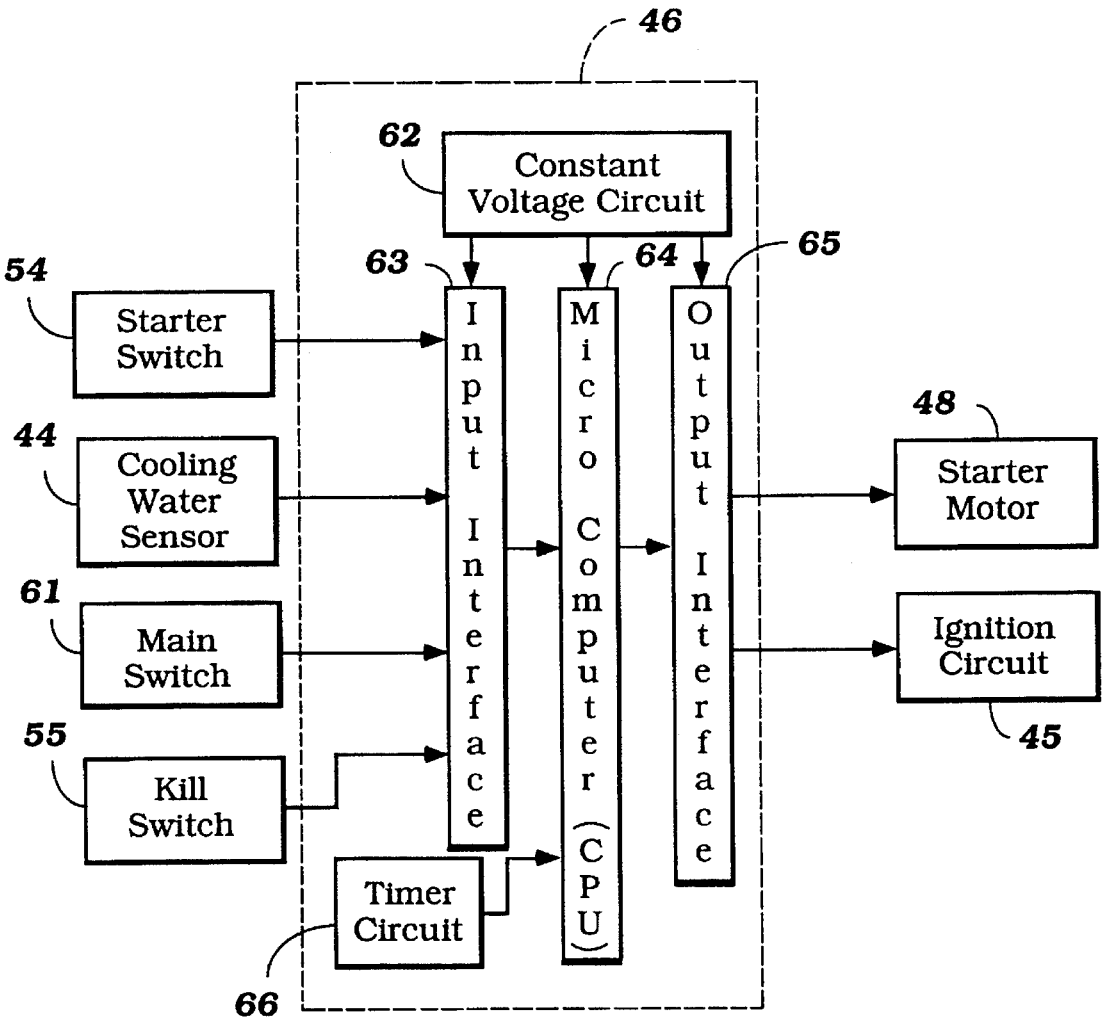
FIG. 4 is a block diagram showing the components of this system and their inner-relationship.

The control box 46 includes a system whereby this purging can be accomplished and this system will be described first by reference to FIG. 4 which shows schematically the relationship of certain components of the system most of which have already been described. As an additional external input, there is provided a main switch 61 which is positioned somewhere in proximity to the controls 15 and which controls the supply of main power from the battery 47 to the various components through the control device 46. The battery 47 supplies electrical power to a constant voltage circuit 62 that provides a constant source of voltage at a predetermined value to the internal components of the control 46 including an input interface 63, a micro-computer or CPU 64 and an output interface 65. In addition, a timer circuit 66 of the multi-vibrator type outputs a timer signal to the micro-computer of CPU 64 for a purpose to be described.

The starter switch, cooling water sensor, main switch and kill switch 54, 44, 61 and 55 respectively, all communicate with the input interface 63 while the output interface 65 outputs signal to the starter motor 48 and ignition circuit 45. The cooling water sensor 44 is shown schematically in FIG. 3 and may either be a device that senses the pressure of coolant in the cooling jacket 38 or a temperature responsive device which, assuming the temperature is low, will indicate the presence of water and which will become heated when the water is out of the cooling jacket 38 so as to indicate an absence of water. Various other types of water sensing devices may be employed so as to provide a signal to the input interface 63 and micro-computer 64 to indicate the presence or absence of coolant in the engine cooling jacket.

Also, the specific location of the cooling water sensor 44 depicted is only that of a preferred embodiment and various other locations are possible for this sensor.

The control routine under which the micro-computer 64 operates so as to function in accordance with the invention will now be described in detail by reference to FIG. 5. As to the normal control arrangement for the control box 46, this may be of any known type and where descriptions of the control circuit are not made, those skilled in the art can readily select from any well known arrangements or their utilization.

Figure 5:
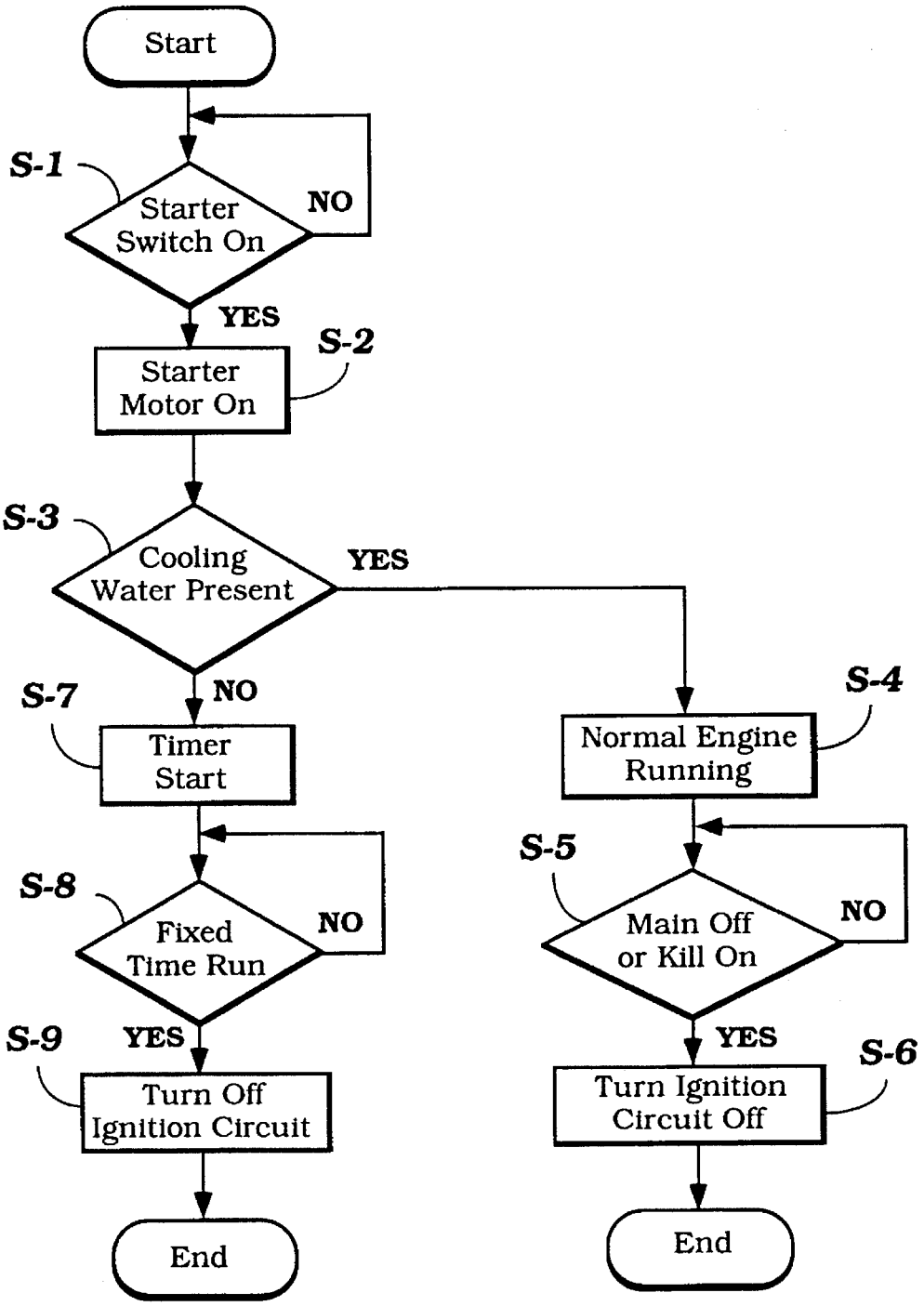
FIG. 5 is a diagrammatic view showing the control routine in accordance with an embodiment.

Referring now to FIG. 5, the described system for purging the engine of coolant and for starting the engine is dependent upon the operation of the starter switch 54 with either the purging operation or actual engine starting being initiated by the operators closure of the starter switch 54. It is to be understood that this is merely one of several possible ways in which the operation of the purging can be initiated. However, by using a single switch for both starting and purging purposes the system can be simplified and the number of controls which the operator must operate can be reduced.

The program starts at the step S-1 to determine the condition of the starter switch. If at the step S-1 the starter switch is not determined to be on then the program repeats.

If, however, the starter switch is determined to have been closed at the step S-1, the program then moves to the step S-2 to confirm that the starter motor is running. If the starter motor is determined to be on at the step S-2 the program then moves to the step S-3 to determine if there is cooling water in the engine. The reason for this determination is that if it is determined that there is cooling water in the engine cooling jacket then it is assumed that the watercraft is in a body of water as indicated in FIG. 1 where the water level is indicated by the line L and water will be delivered to the engine cooling jacket through the coolant delivery system as thus far described.

Under this condition, the program moves to the step S-4 and its sub-program which is the normal engine starting and running condition. This normal engine running condition is maintained until it is determined at the step S-5 that the main switch has been turned off or the kill switch has been turned on. If neither condition exists the program repeats.

If, however, at the step S-5 it has been determined that either the main switch has been turned off or the kill switch has been turned on then the program moves to the step S-6 so as to turn the ignition control circuit 45 off, once this has been accomplished then the program ends.

If, however, at the step S-4 it has been determined by the condition of the water sensor switch 44 that no coolant is present in the engine cooling then the program moves to the engine vapor cooling purge sequence beginning at the step S-7 wherein the timer circuit 66 is started to run. The timer circuit 66 is pre-set to a time period when it will be known that the engine 32 can be safely run and will reach a temperature high enough to purge both the interior of the engine and the interior of its cooling jackets of any water which may be present. However, this time period is also set short enough that the engine will not be damaged by running without coolant.

The program then moves to the step S-8 bearing in mind that the engine will have been started and running by the operation of the starter motor, to determine if the timer period has run, this decision being made the micro-computer or CPU 64. If at the step S-8 the fixed time has not been found to run the program repeats. If, however, the fixed time has run then the program moves to the step S-9 so that the output interface 65 will switch off the ignition circuit 45. The program then ends.

It should be readily apparent from the foregoing description that the described arrangement is very effective in providing an automatic fixed time of running of the engine upon closing of the starter switch once the cooling jacket has been drained of water to purge any water vapor from the interior of the engine or its cooling jacket and not such a long time as to cause over heating. Of course, the foregoing description is that of a preferred embodiment of the invention and the various changes and modifications may be made without departing from the spirit and scope of the invention, as defined by the appended claims.

We claim:

1. A device for assisting a purging of water from a watercraft marine engine having a cooling jacket though which coolant is circulated from a body of water when said engine is propelling an associated watercraft, said device comprising means for sensing the flow of water through said cooling jacket and means for automatically running said engine for only a pre-determined time period after the flow of coolant to said cooling jacket is sensed to have been discontinued for purging said cooling jacket of water, comprising a timer set to begin timing upon the sensing of discontinuance of flow for running the engine at the pre-set time so as to insure that the engine will reach an appropriate temperature for purging the water without over heating of the engine.

2. A device for assisting purging of water from a watercraft marine engine having a cooling jacket through which coolant is circulated from a body of water when said engine is propelling and associated watercraft, a starter for starting the engine, an operator-controlled starter switch for operating said starter, and an operator-controlled stop switch for stopping the running of said engine, said device comprising means for sensing the flow of water through said cooling jacket and means for automatically running said engine for only a pre-determined time period so as to insure that the engine will reach an appropriate temperature for purging the water without over heating of the engine when said starter switch is operated if no flow of coolant in said cooling jacket is sensed when running the engine is initiated by operation of said starter switch and for operating said engine continuously until the operator stops said engine by actuating the stop switch if the flow of water through the cooling jacket is sensed.

3. A device as set forth in claim 1 wherein the presence of coolant in the engine cooling jacket is determined by an engine coolant sensor.

4. A device as set forth in claim 3 wherein the engine is stopped after the pre-determined time by discontinuing operation of its ignition circuit.

5. A device as set forth in claim 4 wherein the timer is run only if a main ignition switch is turned on and a kill switch is not turned on.

6. A method for purging of water from a watercraft marine engine having a cooling jacket through which coolant is circulated from a body of water when said engine is propelling an associated watercraft, said method comprising the steps of sensing the flow of coolant in the cooling jacket, running said engine only for a pre-determined time after the flow of water to the cooling jacket is sensed to have been discontinued for purging the water from the cooling jacket, the predetermined time being sufficient to ensure that the engine will reach an appropriate temperature for purging the water without overheating of the engine.

7. A method for purging of water from a watercraft marine engine having a cooling jacket through which coolant is circulated from a body of water when said engine is propelling an associated watercraft, a starter for starting the engine, a manually operated starter switch for operating the starter in response to operation of the starter switch, and a manually operated stop switch for stopping the running of the engine, said method comprising the steps of sensing the flow of coolant in the cooling jacket, running said engine only for a predetermined time sufficient to ensure that the engine will reach an appropriate temperature for purging water without overheating the engine if no flow of water to the cooling jacket is sensed, and for running the engine continuously until stopped by the operator by activating the stop switch if the flow of cooling water is sensed.

8. A method as set forth in claim 6 wherein the flow of coolant in the engine cooling jacket is determined by an engine coolant sensor.

9. A method as set forth in claim 6 wherein the engine is stopped after the pre-determined time by discontinuing operation of its ignition circuit.

10. A method as set forth in claim 9 wherein the engine is run for the predetermined time only if a main ignition switch is turned on and a kill switch is not turned on.

* * * * *